US008593355B1

(12) United States Patent
Tonn

(10) Patent No.: US 8,593,355 B1
(45) Date of Patent: Nov. 26, 2013

(54) RECONFIGURABLE BUOYANT CABLE ANTENNA WITH IMPROVED GAIN

(75) Inventor: David A. Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 685 days.

(21) Appl. No.: 12/822,523

(22) Filed: Jun. 24, 2010

(51) Int. Cl.
*H01Q 1/34* (2006.01)

(52) U.S. Cl.
USPC ..... 343/709

(58) Field of Classification Search
USPC ..... 343/709
See application file for complete search history.

(56) References Cited

U.S. PATENT DOCUMENTS 6,426,464 B1 * 7/2002 Spellman et al. ..... 174/101.5

* cited by examiner

*Primary Examiner* — Hoang V Nguyen
*Assistant Examiner* — Kyana R Robinson
(74) *Attorney, Agent, or Firm* — James M. Kasischke; Jean-Paul A. Nasser; Michael P. Stanley

(57) ABSTRACT

An antenna element with a single-conductor antenna is provided within a removable core. The removable core is mounted within a hollow liner by sliding the core into the hollow liner. A pull cable may be attached to an end of the removable core to pull the core through the outboard end of the hollow liner. Due to reduced strain on the core as compared to the liner, the single-conductor antenna may be formed in segments interconnected with capacitors for adjusting the antenna gain to a maximum in the vicinity of a desired operating frequency or frequencies.

14 Claims, 4 Drawing Sheets

RECONFIGURABLE BUOYANT CABLE ANTENNA WITH IMPROVED GAIN

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

BACKGROUND OF THE INVENTION

1. Field of the Invention

The present invention relates generally to a buoyant cable antenna (BCA) suitable for submarine communications and, more particularly, to a reconfigurable buoyant cable antenna element for the (BCA) system.

2. Description of the Prior Art

The buoyant cable antenna is one of a host of antennas currently in use by submarines. It is used for wireless electronic communications while the submarine is submerged.

The prior art antenna element for a buoyant cable antenna comprises a core that consists of a cylindrical insulated single-wire with a cylindrical layer of insulation. A buoyancy layer/jacket is either injection molded or extruded in place onto the core to make the final structure a solid object. This arrangement makes it impossible to remove the core if the core becomes damaged or if a new kind of core is needed to meet a specific mission. This arrangement also makes it impossible to reconfigure the antenna for other applications or specific applications.

Current designs for buoyant cable antennas suffer from limited gain and bandwidth performance due to the resonant behavior of the antenna element. For example, it is not possible to insert circuit elements into the single-wire antenna to change its behavior due to the stress that is applied to the core during towing.

The following U.S. patents describe various prior art systems that may be related to the above and/or other buoyant cable antenna systems:

U.S. Pat. No. 5,745,436, issued Apr. 28, 1998, to Bittleston, discloses a semi-dry marine seismic streamer cable that consists of a number of connected streamer cable sections, which each comprise a mechanical jacket surrounding a hollow core enclosing seismic sensor and signal transfer means. Elongated axial stress elements for transmitting axial loads and a radial reinforcement member for relieving radial loads are provided in the jacket. The core is filled with a fluid or a fluid-saturated foam and the sensor means are mounted in the core by vibration isolating elements.

U.S. Pat. No. 6,426,464, issued Jul. 30, 2002, to Spellman et al, discloses a cable sectional assembly that houses an electrically concatenated series of electronic circuit modules and has electric hook-up media interspersed between the modules. Each run of interspersed hook-up media is surrounded by a flexible tubular member, which is oversized to allow movement of the hook-up media without restriction under flexing of the assembly. The assembly is a construction and arrangement of two forms of moldingly bonded encapsulations. The first of these forms is made of a hard encapsulant and forms a unitary encapsulation local to each electronic module which (i) encapsulates the circuit module and associated electrical coupling connections between the adjacent end of each individual run of an adjacent interspersed run of media and an electrical terminal of the module, and (ii) is securely bonded to the adjacent marginal end portions of the tubular members which surround the adjacent interspersed runs of hook-up media. The second form is an overmolded annular encapsulation made of a softer flexible encapsulant which fills the annular spaces between the encapsulations of the first form, and which is securely moldingly bonded to the midportion of the tubular member and the adjacent lateral surfaces of the encapsulations of the first form. Both the first and second forms of encapsulations are made of cool curing types of encapsulants.

U.S. Pat. No. 6,473,365, issued Oct. 29, 2002, to Joh et al, discloses a support structure of hydrophones for a towed array sonar system, which includes elastic members arranged in each sensor package and adapted to support a hydrophone received in the sensor package while attenuating vibrations transmitted to the sensor package. External vibrations, such as vibrations generated due to the running of a towing vessel or vibrations induced due to motions of a towing cable, which are irrespective of acoustic waves reflected by a target moving underwater, are attenuated by the hydrophone support structure during the transmission thereof from the sensor package to the hydrophones, so that the hydrophones are suppressed from vibrating due to the external vibrations.

U.S. Pat. No. 6,982,383, issued Jan. 3, 2006, to Spellman et al, discloses a cable section assembly for marine applications having a core structure, such as a buoyant cable antenna interim manufacturing step subassembly, and a protective casing formed from heat shrinkable tubing, which together with the interim subassembly forms a complete assembly. For buoyant cable assembly applications the interim subassembly is at least partially formed of polyurethane material having glass microballoons distributed therein, with such material in any event occupying an outer layer portion of the subassembly. The cable section assembly of the present invention is formed by providing a length of heat shrinkable flexible tubing, inflating or expanding the heat shrinkable tubing to its approximate full diameter, inserting the core structure into the length of tubing, and shrinking the tubing around the core structure.

U.S. Pat. No. 7,429,957, issued Sep. 30, 2008, to Tonn, discloses a buoyant cable antenna element that employs a specific double-negative meta-material sheath with a negative permeability. The double-negative meta-material sheath is disposed over the insulated wire portion of the buoyant cable antenna element. The double-negative meta-material sheath enables a deliberate reduction in the antenna wire inductance to a zero value at a desired critical frequency. Reducing the antenna wire inductance to zero creates a traveling wave structure antenna having enhanced bandwidth.

The above cited prior art does not disclose reuse of the core of the antenna element of a buoyant cable antenna and/or provide a core that can be removed and/or replaced by a different core and/or a core which may be customized for a particular application. Moreover, the above-cited art does not disclose an antenna element core that floats within air in a liner and/or which is slidable within the liner to be isolated from strain. Moreover, the above-cited art does not disclose an antenna element core for a buoyant cable antenna that permits the use of miniaturized electrical components in the antenna element itself due to the strain exerted during towing.

The solutions to the above described and/or related problems have been long sought without success. Consequently, those skilled in the art will appreciate the present invention that addresses the above and other problems.

SUMMARY OF THE INVENTION

It is a general object of the present invention to provide an improved antenna element for a buoyant cable antenna.

Another possible object of the present invention is to provide a removable/replaceable antenna element core.

Another possible object of the present invention is to provide an antenna element for a buoyant cable antenna with improved gain in the frequency ranges of interest.

Another possible object of the present invention is to provide an antenna element for a buoyant cable antenna with improved gain in the high frequency (HF) radio band (3-30 MHz).

Accordingly, the present invention provides an antenna element in a buoyant cable antenna, which is towed by a submarine. The antenna element may comprise one or more elements such as, for example only, a removable core that may comprise a straight cylindrical single-conductor wire, which acts as an antenna. The straight cylindrical single-conductor wire may be coated with a layer of insulation.

A liner surrounds the removable core. The liner defines a hollow interior with an inner diameter. The outer diameter of the removable core is sufficiently smaller than the inner diameter of the hollow interior such that the removable core is slidable with respect to the liner during installation of the removable core within the liner. The liner may further comprise a buoyancy jacket that is operable to provide that the antenna element is buoyant in water.

A pull cable may be secured to an outboard end of the removable core. The pull cable is sufficiently strong enough to pull the removable core into the liner and sufficiently long to pull the removable core into the liner from an outboard end of the liner.

A watertight cap is secured to the outboard end of the liner so that the pull cable is stored within the hollow interior of the liner inside of the watertight cap.

In one embodiment, the hollow interior is filled with air, which surrounds the removable core. In one embodiment, the core has a length in a range of from forty feet to sixty feet.

In another embodiment, the straight cylindrical single-conductor wire comprises a plurality of segments and may further comprise a plurality of capacitors, which interconnect the plurality of segments. The capacitors may be used to adjust the performance of the antenna or to optimize it near a desired frequency.

In another embodiment, the straight cylindrical single-conductor wire may or may not comprise a plurality of segments. If desired, any segments may be interconnected utilizing microelements such as capacitors, filters, amplifiers, sensors, and the like.

In another embodiment, the invention comprises a method for making an antenna element for use in a buoyant cable antenna for towing by a submarine. The method may comprise one or more steps such as, for example, providing a removable core, which comprises a straight cylindrical single conductor wire to act as an antenna, and providing a liner to surround the removable core.

Other steps may comprise providing that the liner define a hollow interior with an inner diameter. The removable core may comprise an outer diameter sufficiently smaller than the inner diameter of the hollow interior such that the removable core is slidable with respect to the liner during mounting of the core within the liner. The method may further comprise providing that the liner comprises a buoyancy jacket, which is operable to provide that the antenna element is buoyant in water.

In one possible embodiment, the method may comprise the steps of attaching a pull cable to an outboard end of the removable core, and providing that the pull cable is sufficiently strong enough and long enough to pull the removable core into the liner from an outboard end of the liner.

The method may further comprise securing a watertight cap to the outboard end of the liner such that the pull cable is stored within the hollow interior of the liner inside of the watertight cap.

The method may further comprise providing that the hollow interior be filled with air that surrounds the removable core.

The method may further comprise providing that the straight cylindrical single conductor wire comprises a plurality of segments and may further comprise interconnecting the plurality of segments using a plurality of capacitors. The method may further comprise utilizing the capacitors for adjusting the performance of the antenna or for optimizing it near a desired frequency. In more detail, the method may further comprise utilizing a length of the segments and a size of the capacitors for adjusting the peak gain to occur near a desired frequency.

In another embodiment, the method may further comprise providing that the straight cylindrical single conductor wire comprises a plurality of segments and may further comprise interconnecting the plurality of segments using a plurality of microelements.

The method may further comprise providing that said removable core has a length in a range of from forty feet to sixty feet.

In one preferred embodiment, the removable core is mounted to have sufficiently less strain applied thereto during towing than the liner whereby segments of the straight cylindrical single conductor wire can be connected utilizing relatively fragile elements such as microelements, as discussed hereinafter.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DETAILED DESCRIPTION OF THE INVENTION

The present invention provides a reconfigurable buoyant cable antenna (BCA). In one embodiment, the BCA has improved gain performance. The antenna element core can also be removed and replaced based on mission needs. Accordingly, the present invention provides an important improvement in BCA technology.

Figure 1:
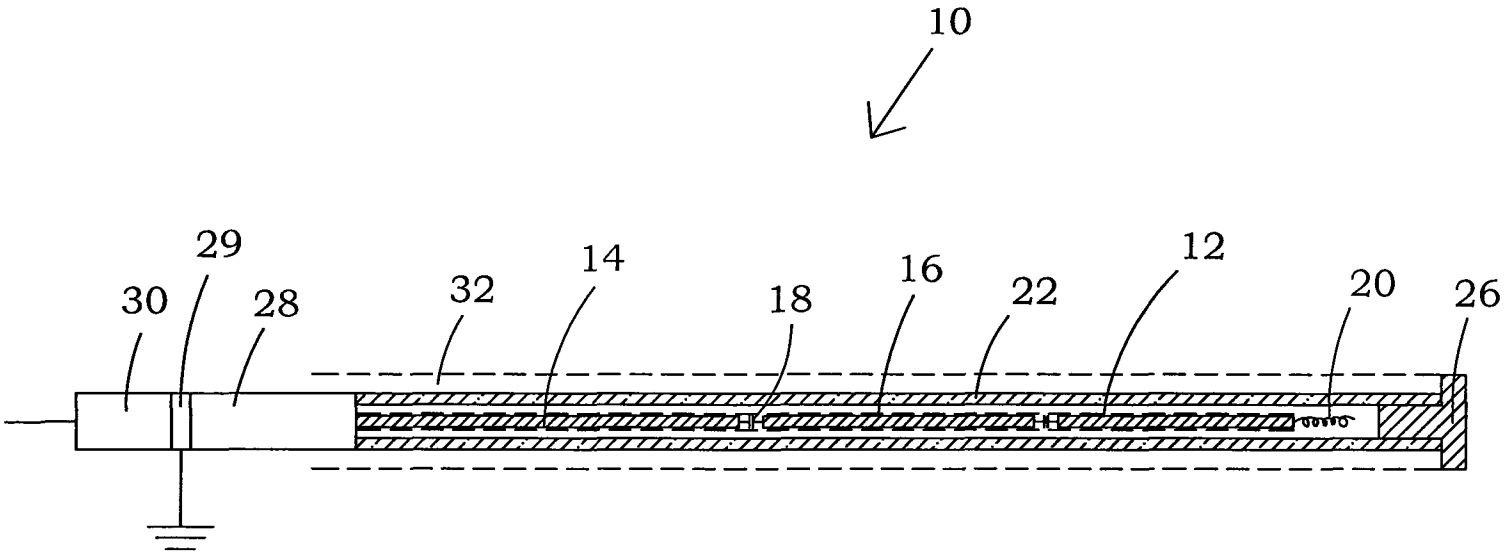
FIG. 1 is an elevational view, partially in section, showing a schematic for an antenna element for a buoyant cable assembly in accord with one possible embodiment of the present invention.
Figure 1A:
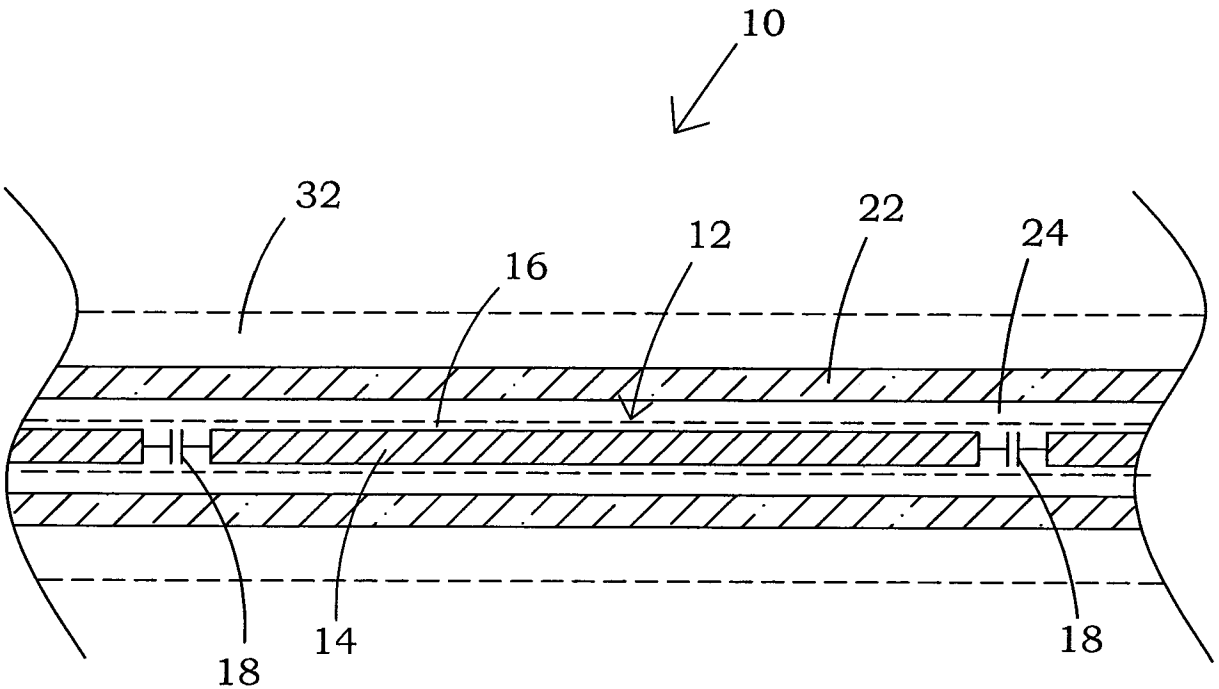
FIG. 1A is an enlarged elevational view, partially in section, showing a schematic with capacitors connected in series with the antenna element for a buoyant cable assembly in accord with one possible embodiment of the present invention.

Referring now to the drawings and, more particularly to FIG. 1 and FIG. 1A, there is shown a schematic view of antenna element 10 for a buoyant cable antenna. FIG. 1 and FIG. 1A show core 12 of antenna element 10. Core 12 comprises straight cylindrical wire 14, which may be a desired size wire, e.g. #18 AWG. Best shown in FIG. 1A, foam insulating layer 16, which may comprise a desired thickness, e.g., 0.177" OD, is provided around straight cylindrical wire 14.

In one embodiment, at desired intervals, which may be regular intervals, along the length of core 12, wire 14 is interrupted into segments which are connected by electronic elements which may be microelements such as series capacitors 18. Capacitors 18 may be ceramic capacitors. The product of this capacitance and the spacing is known as the "load factor" for the antenna and plays an important role in determining where in the HF band the antenna has its best performance.

Figure 2:
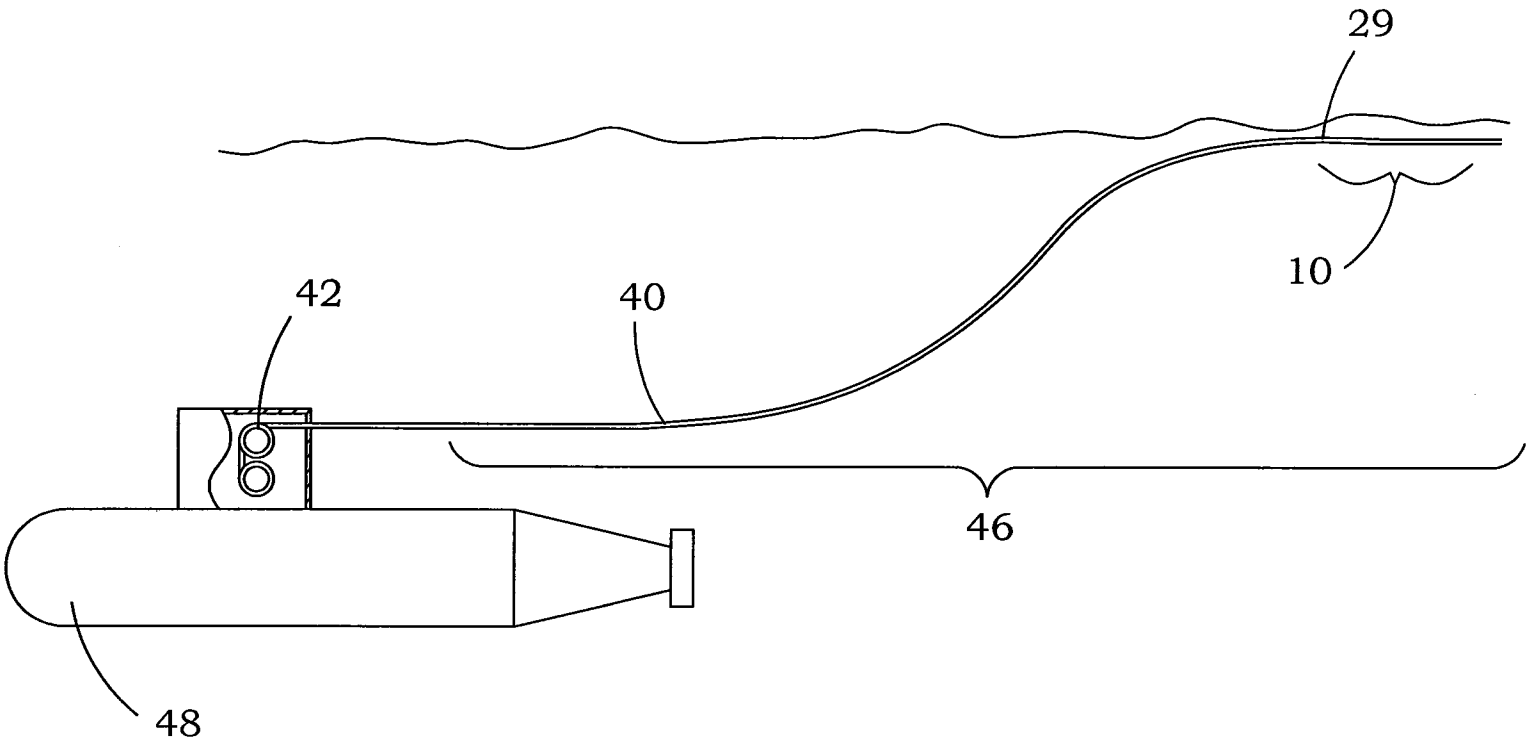
FIG. 2 is a schematic elevational view, partially in section, showing use of a buoyant cable assembly in accord with one possible embodiment of the present invention.

In one possible embodiment, the length of core 12 may be in the range of about 40-60 feet. In one possible embodiment, string or pull cable 20, which may be comprised of Kevlar, may be attached to core 12 at the outboard end, e.g., the outermost end thereof. In this embodiment, string or pull cable 20 may then be utilized to pull core 12 into liner 22. Liner 22 may be polyethylene. There exists sufficient clearance 24 between core 12 and liner 22 to allow core 12 to easily slide in and out of liner 22 with a minimum of friction. This arrangement not only provides a way to remove core 12, but also provides a means by which core 12 is strain-relieved and does not see any of the tensile force that liner 22 sees during towing as shown in FIG. 2, thereby protecting core 12 from damage, e.g., pulling capacitors 18 apart.

A portion of string 20 used to pull the core into liner 22 may be left inside the outermost end of liner 22 before installing watertight cap 26. This is done to allow core 12 to be pulled back into liner 22 should it be necessary to remove core 12. The other end 28 of liner 22 may be fitted with a watertight BCA connector 29 and then attached to a standard BCA coaxial feed 30.

To remove core 12, cap 26 on the outboard or outermost end is removed so that string 20 can be grasped and prevented from being pulled into liner 22 during the next step. Then inboard connector 29 is removed and core 12 is pulled out of liner 22. This pulls some of string 20 back into the liner 22 but the free end is not pulled into the liner. The old core may then be cut from the string and the new core attached. String 20 may then be used to pull the new core into liner 22.

During one test, a 51 foot long core was pulled into a liner by means of Kevlar string or pull cable 20. String or pull cable 20 was originally pulled into liner 22 by means of a vacuum cleaner. However, other means, e.g., a long straight wire, could also be utilized to insert string 20 into liner 22.

In a preferred embodiment, liner 22 comprises buoyancy jacket 32 extruded on an outer surface of liner 22 to give the antenna better speed-depth performance when being towed from a submerged submarine.

FIG. 2 shows antenna element 10 in buoyant cable antenna 46 which is deployed by submarine 48 utilizing deployment mechanism 42. Buoyant cable antenna 46 may have various sections or elements such as signal lead-in and tow cable section 40, which may comprise a non-buoyant portion. At the outboard end or outermost end of buoyant cable antenna 46 is buoyant single conductor antenna element 10. In one embodiment, antenna element 10 may be about 50 feet long and/or be within a range of from forty to sixty feet long. However, antenna element 10 may be longer or shorter than this range if desired.

Figure 3:
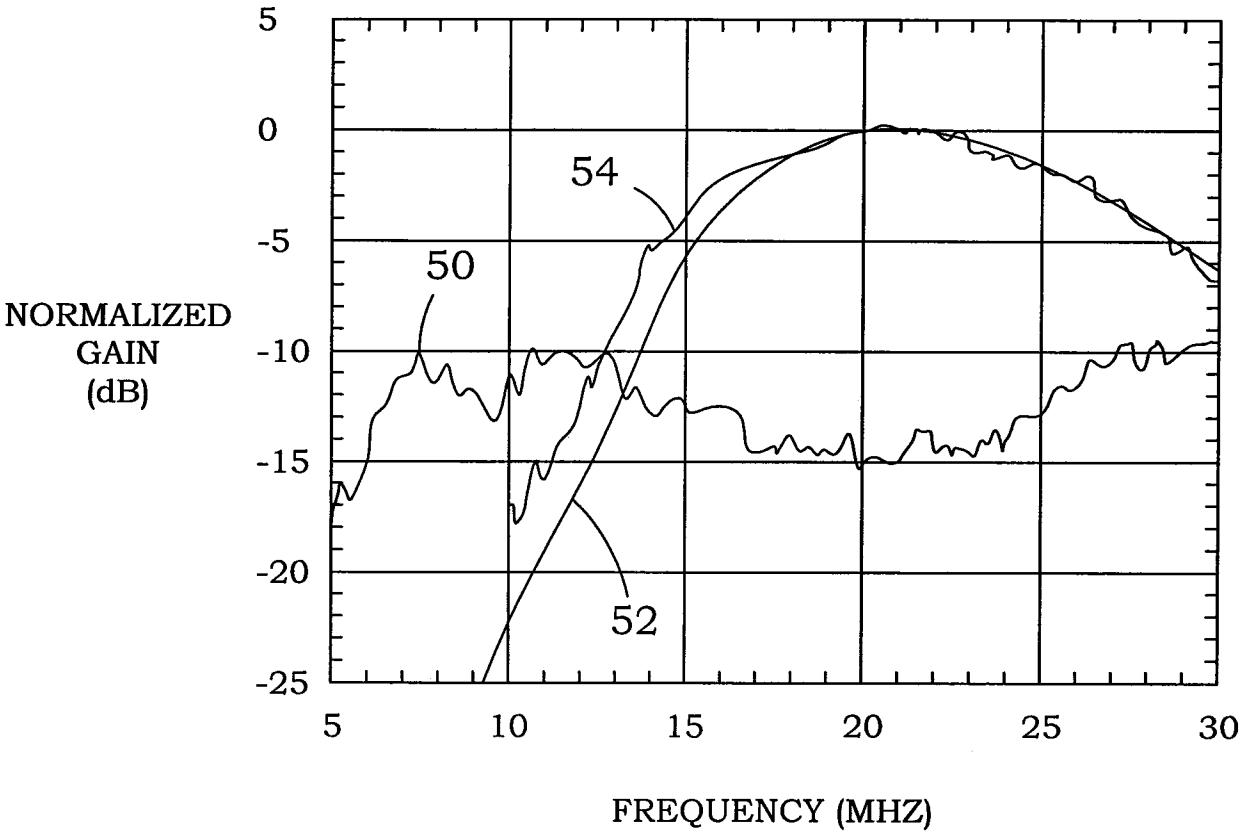
FIG. 3 is a graph showing a comparison of frequency response, both calculated and actual, as compared to a prior art antenna element for a buoyant cable assembly in accord with one possible embodiment of the present invention.

FIG. 3 illustrates the improved antenna gain for one embodiment of the present invention. Curve 50 shows a typical response for a 50 foot prior art antenna over a range of 5 MHz to 30 MHz. Curve 52 is the calculated gain of an antenna in accord with one embodiment of the present invention utilizing capacitors 18 and/or adjusting the length of core 12. Curve 54 shows the measured gain of antenna in accordance with the present invention. In this embodiment, the peak gain at approximately 20 MHz is considerably higher than that of the prior art antenna core. By increasing the length of the antenna and adjusting the loading factor, the frequency at which peak gain occurs can be lowered. By shortening the antenna and adjusting the loading factor, the frequency at which peak gain occurs can be increased. The correct value of the loading factor depends on the antenna length and geometry. Thus, the above describe factors can be utilized to adjust the maximum gain to within the vicinity of the desired operating frequency or range of frequencies.

Accordingly, the present invention provides a means for re-use of antenna element 10 by allowing core 12 to be removed and replaced with a different core that is customized for a particular application. The preferred embodiment uses a core designed for substantially improved gain performance. In addition, the fact that the core now "floats" mechanically inside liner 22 provides a means for strain relief of the core and components thereof. In the prior art BCA, the core is integrated into the jacket and so must be able to bear the mechanical strain seen while being towed, precluding the use of miniaturized electrical elements in the core assembly.

As discussed above, the preferred embodiment of antenna element 10 comprises a buoyancy jacket 32 over liner 22, wherein liner 22 defines a hollow center that houses core 12. In another embodiment, the jacket could be made of several layers including an inner mechanical strain-bearing layer followed by the buoyancy layer, and finally a surface finish layer. Various types of cores could also be used. In the above-described invention, core 12 may consist of a periodic structure comprising insulated wire segments and capacitors. This core may be replaced with a single uninterrupted conductor, or one with integrated electronics, e.g. amplifiers, filters, sensors, and the like.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. An antenna element in a buoyant cable antenna, said buoyant cable antenna being connected to a submarine, said antenna element comprising:

a removable core comprising a straight cylindrical single-conductor wire that acts as an antenna, said straight cylindrical single-conductor wire being coated with a layer of insulation;

a liner surrounding said removable core, said liner defining a hollow interior with an inner diameter, said removable core comprising an outer diameter sufficiently smaller than said inner diameter of said hollow interior such that said removable core is slidable with respect to said liner during mounting of said removable core within said liner, said liner further comprising a buoyancy jacket which is operable to provide that said antenna element is buoyant in water;

a pull cable secured to an outboard end of said removable core, said pull cable being sufficiently strong enough to pull said removable core into said liner, said pull cable being sufficiently long to pull said removable core into said liner from an outboard end of said liner; and a watertight cap secured to said outboard end of said liner, said pull cable being stored within said hollow interior of said liner inside of said watertight cap.

2. The antenna element of claim 1, wherein said hollow interior is filled with air, which surrounds said removable core.

3. The antenna element of claim 1, wherein said straight cylindrical single-conductor wire comprises a plurality of segments and further comprising a plurality of capacitors, which interconnect said plurality of segments.

4. The antenna element of claim 3, wherein said capacitors are operable for use in adjusting a performance of said antenna whereby a maximum gain is provided near a desired frequency.

5. The antenna element of claim 1, wherein said straight cylindrical single-conductor wire comprises a plurality of segments and further comprising a plurality of microelements, which interconnect said plurality of segments.

6. The antenna element of claim 1, wherein said core has a length in a range of from forty feet to sixty feet.

7. A method for making an antenna element for use in a buoyant cable antenna connected to a submarine, said method comprising the steps of:

providing a removable core, which comprises a straight cylindrical single-conductor wire to act as an antenna;

providing a liner to surround said removable core, and providing that said liner defines a hollow interior with an inner diameter, said removable core comprising an outer diameter sufficiently smaller than said inner diameter of said hollow interior such that said removable core is slidable with respect to said liner during mounting of said removable core within said liner, and further providing that said liner comprises a buoyancy jacket which is operable to provide that said antenna element is buoyant in water;

attaching a pull cable to an outboard end of said removable core and providing that said pull cable is sufficiently strong enough and long enough to pull said removable core into said liner from an outboard end of said liner;

securing a watertight cap to said outboard end of said liner; and providing that said pull cable is stored within said hollow interior of said liner inside of said watertight cap.

8. The method of claim 7, further comprising providing that said hollow interior is filled with air that surrounds said removable core.

9. The method of claim 7, further comprising providing that said straight cylindrical single-conductor wire comprises a plurality of segments and further comprising interconnecting said plurality of segments using a plurality of capacitors.

10. The method of claim 9, further comprising utilizing said capacitors for adjusting a gain of said antenna so that a maximum gain is provided within plus or minus 15% of a desired frequency.

11. The method of claim 10, further comprising utilizing a length of said segments and a size of said capacitors for adjusting said maximum gain of said antenna near a desired frequency.

12. The method of claim 7, further comprising providing that said straight cylindrical single-conductor wire comprises a plurality of segments and further comprising interconnecting said plurality of segments using a plurality of microelements.

13. The method of claim 7, further comprising providing that said removable core has a length in a range of from forty feet to sixty feet.

14. The method of claim 13, wherein said removable core is mounted to have sufficiently less strain applied thereto during towing than said liner, whereby segments of said straight cylindrical single conductor wire are connected utilizing microelements.

* * * * *